US008480009B2

(12) United States Patent
Hanson et al.

(10) Patent No.: US 8,480,009 B2
(45) Date of Patent: Jul. 9, 2013

(54) LARGE BORE FUEL SYSTEM AND FUEL INJECTOR FOR SAME

(75) Inventors: Christopher D. Hanson, Secor, IL (US); Stephen Lewis, Chillicothe, IL (US); Qursheed Hussain Mohammed, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 12/847,386

(22) Filed: Jul. 30, 2010

(65) Prior Publication Data

US 2012/0024973 A1 Feb. 2, 2012

(51) Int. Cl.
*F02D 1/06* (2006.01)
*F02M 41/16* (2006.01)

(52) U.S. Cl.
USPC ..... 239/5; 239/88; 239/96

(58) Field of Classification Search
USPC ..... 239/95, 96, 132–132.5, 585.1–585.5, 239/5
See application file for complete search history.

(56) References Cited

U.S. PATENT DOCUMENTS

| | | | |
|---|---|---|---|
| 6,471,142 | B1 | 10/2002 | Lambert |
| 2001/0020467 | A1 | 9/2001 | Coldren et al. |
| 2008/0017169 | A1 | 1/2008 | Hlousek et al. |
| 2008/0053408 | A1 | 3/2008 | Futonagane et al. |
| 2010/0084489 | A1 | 4/2010 | Chang |

FOREIGN PATENT DOCUMENTS

| | | |
|---|---|---|
| DE | 19939453 | 8/1999 |
| EP | 1719904 | 3/2006 |
| EP | 2071177 | 6/2009 |
| WO | WO2005119045 | 12/2005 |

*Primary Examiner* — Christopher Kim
(74) *Attorney, Agent, or Firm* — Liell & McNeil

(57) ABSTRACT

A low leakage large bore fuel system includes a common rail fluidly connected to at least one of a source of heavy fuel oil and a source of distillate diesel fuel. A plurality of fuel injectors are fluidly connected to the common rail and each include a cooling inlet and a cooling outlet. Each fuel injector also includes an electrical actuator coupled to a direct operated nozzle check valve by a pilot valve member and a control valve member. Fuel leakage is reduced between injection events by equalizing pressures in a pilot control chamber and an intermediate control chamber that are separated by a guide surface of the control valve member. Also, between injection events the pilot valve member blocks a drain outlet from a common rail inlet of the fuel injector.

20 Claims, 4 Drawing Sheets

LARGE BORE FUEL SYSTEM AND FUEL INJECTOR FOR SAME

TECHNICAL FIELD

The present disclosure relates generally to common rail fuel systems for large bore engines, and more particularly to reducing leakage in a large bore fuel system.

BACKGROUND

Common rail fuel injectors spend only a small fraction of their operational time actually injecting fuel, and a vast majority of the remaining time standing by in a pressurized state ready for a subsequent injection event. In many cases, a pressurized area within the fuel injector can be separated from a low pressure area by a guide surface of a movable valve member. Because pressure differentials between the pressurized area and the low pressure area can be relatively high, the pressure gradient tends to cause fuel to migrate up through the guide area to the low pressure region, and this migration of fuel can account for a majority of fuel leakage from a fuel injector. As fuel injection pressures continue to rise, this type of fuel leakage problem can correspondingly become more acute. In addition, as common rail fuel injection systems are scaled for larger and larger engines, the associated fuel injectors can be expected to have larger clearance areas for their larger internal components. Thus, in high pressure common rail systems associated with large bore fuel systems, the fuel leakage along guide surfaces can become unacceptable. Simply scaling up proven solutions from smaller bore fuel injection systems to larger bore fuel injection systems can also be problematic. First, the physics with regard to fluid dynamics, mass properties and pressures, etc. do not scale well. And even if they did scale, the larger bore fuel systems must then necessarily have different components thereby increasing the parts catalog count for an engine manufacturer that manufactures both small and large bore fuel systems and associated engines.

The present disclosure is directed toward one or more of the problems set forth above.

SUMMARY OF THE DISCLOSURE

In one aspect, a large bore fuel system includes a common rail fluidly connected to at least one of a source of heavy fuel oil and a source of distillate diesel fuel. A plurality of fuel injectors each include a cooling inlet, a cooling outlet, and an electrical actuator coupled to a direct operated nozzle check valve by a pilot valve member and a control valve member.

In another aspect, a large bore fuel injector includes an injector body that defines at least one common rail inlet, a drain outlet, a nozzle outlet, a cooling inlet and a cooling outlet. A pilot control chamber, an intermediate control chamber, a needle control chamber and a nozzle chamber are all disposed in the injector body. A pilot valve member is movable between a first position at which the pilot control chamber is fluidly connected to the drain outlet, and a second position at which the pilot control chamber is blocked from the drain outlet. A control valve member has a guide surface separating a first hydraulic surface exposed to fluid pressure in the pilot control chamber, and a second hydraulic surface exposed to fluid pressure in the intermediate control chamber. A needle valve member includes a guide surface separating an opening hydraulic surface exposed to fluid pressure in the nozzle chamber, and a closing hydraulic surface exposed to fluid pressure in the needle control chamber.

In still another aspect, a method of operating a large bore fuel injector includes fluidly connecting a drain outlet to a common rail inlet during an injection event. The drain outlet is blocked from the common rail inlet between injection events. Fuel leakage from the fuel injector is reduced between injection events by equalizing pressures in a pilot control chamber and an intermediate control chamber that are separated by a guide surface of a control valve member, and equalizing pressures in a nozzle chamber and a needle control chamber that are separated by a guide surface of the needle valve member.

DETAILED DESCRIPTION

Figure 1:
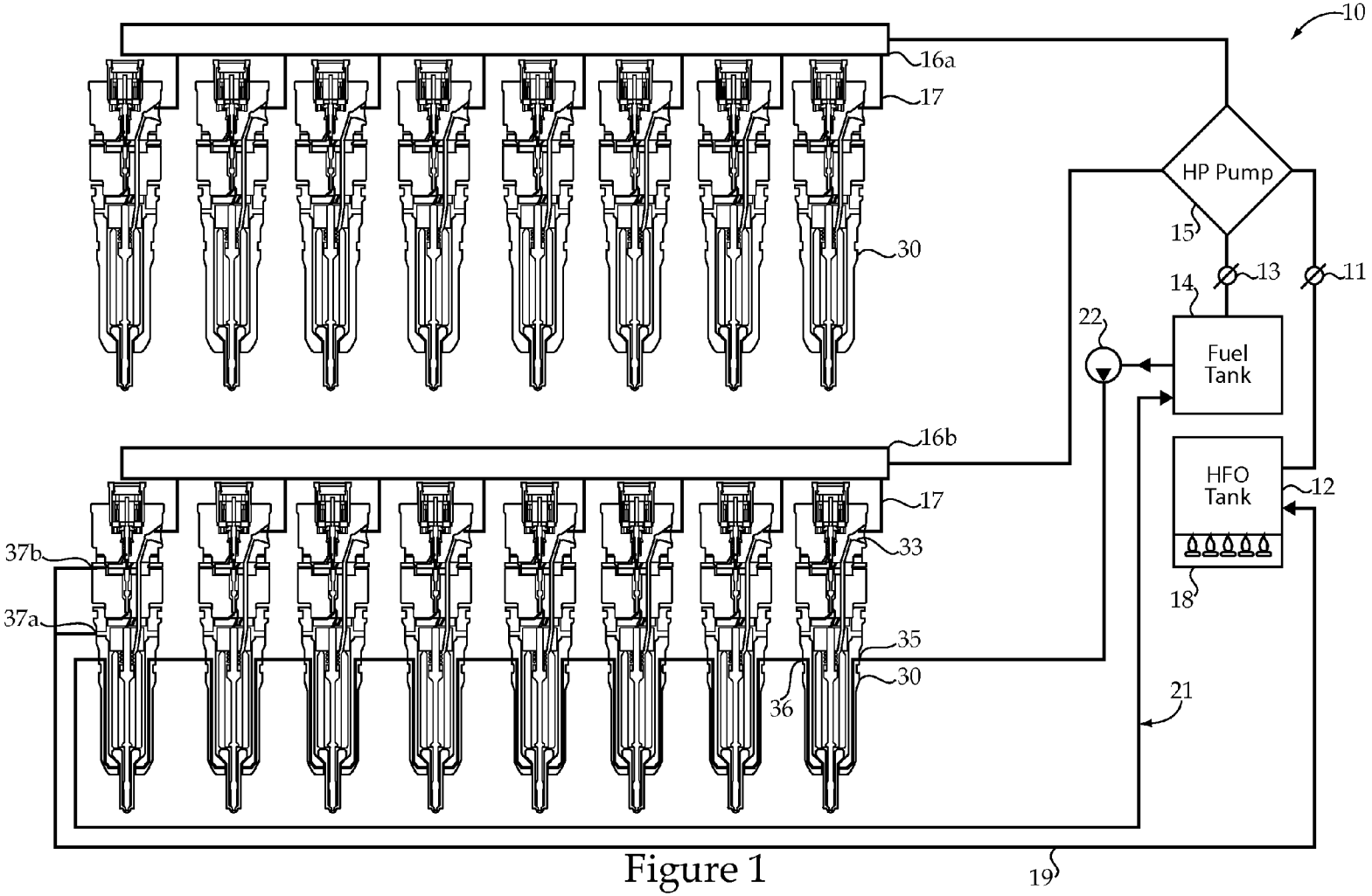
FIG. 1 is a schematic view of a large bore fuel system according to one embodiment of the present disclosure.

Referring to FIG. 1, an example of a low leakage large bore fuel system 10 according to the present disclosure is shown. Fuel system 10 is illustrated for a sixteen cylinder large bore engine having a V configuration. Nevertheless, the concepts of the present disclosure are equally applicable to large bore fuel systems for any engine that is configured to inject both heavy fuel oil and distillate diesel fuel. Fuel system 10 includes a source of heavy fuel oil 12 and a source of distillate diesel fuel 14 that are separated from a high pressure pump 15 by valves 11 and 13, respectively. Thus, when valve 11 is open but valve 13 closed, the fuel system 10 injects heavy fuel oil for combustion in the respective combustion spaces of the engine (not shown). For instance, a ship equipped with an engine and fuel system 10 according to the present disclosure might operate in this configuration on the high seas. However, as the ship and fuel system 10 approach a port, valve 11 may be closed and valve 13 opened so that the engine and associated fuel system 10 are changed over to operate on distillate diesel fuel. High pressure pump 15 supplies high pressure fuel to first and second common rails 16*a* and 16*b*, which each supply fuel to eight separate large bore fuel injectors 30. Each of the fuel injectors 30 may be fluidly connected to one of the common rails 16*a* and 16*b* by a respective branch passage 17. Branch passages 17 may be housed in a quill (not shown) that makes a seal at common rail inlet 33, which may have a conical shape for appropriate sealing. Also shown in FIG. 1 is another common characteristic associated with large bore fuel systems according to the present disclosure, namely the inclusion of a cooling circuit 21 and a heater 18. Those skilled in the art will appreciate that heavy fuel oil must be heated to several hundred degrees before it can be made suitably non-viscous to flow through fuel system 10. Thus, heater 18 may be associated with the source of heavy fuel oil 12, and one or more additional heaters may or may not be included elsewhere in fuel system 10 in order to maintain the heavy fuel oil at a flow temperature. Cooling circuit 21, on the otherhand, may utilize distillate diesel fuel that is circulated from the source of distillate diesel fuel 14 by a circulation pump 20. The cooling circuit operates by sequentially supplying cooling fuel to a cooling inlet 35 which circulates within the fuel injector, especially near the tip, and then exits at cooling outlet 36 for circulation into an adjacent fuel injector 30. Those skilled in the art will appreciate that the characteristic commonly associated with large bore fuel systems is the need to cool the fuel injectors during operation to prevent degradation and potential malfunction due to overheating. Those skilled in the art will also appreciate that, although fuel system 10 is illustrated as using distillate diesel fuel as a coolant and as an injection medium depending upon the configuration of valves 11 and 13, other fluids (e.g. lubricating oil) could be used in cooling circuit 21 without departing from the present disclosure.

Each of the fuel injectors 30 is electronically controlled. As such, during injection events, the control function within the individual fuel injectors 30 may require that the respective common rail 16*a* or 16*b* be fluidly connected to a return line 19 in order to electronically control each injection event. In the illustrated embodiment, only one return line 19 is shown and it is for returning fuel that arrives at the fuel injectors 30 but is not injected, and instead expelled during control of an injection event to be routed to the source of heavy fuel oil 12 for potential recirculation and injection in a subsequent event. Return line 19 is shown fluidly connected to source of heavy fuel oil 12 instead of source of distillate diesel fuel 14 because it is often more desirable to dilute the heavy fuel oil with distillate diesel fuel, rather than vice versa.

Figure 2:
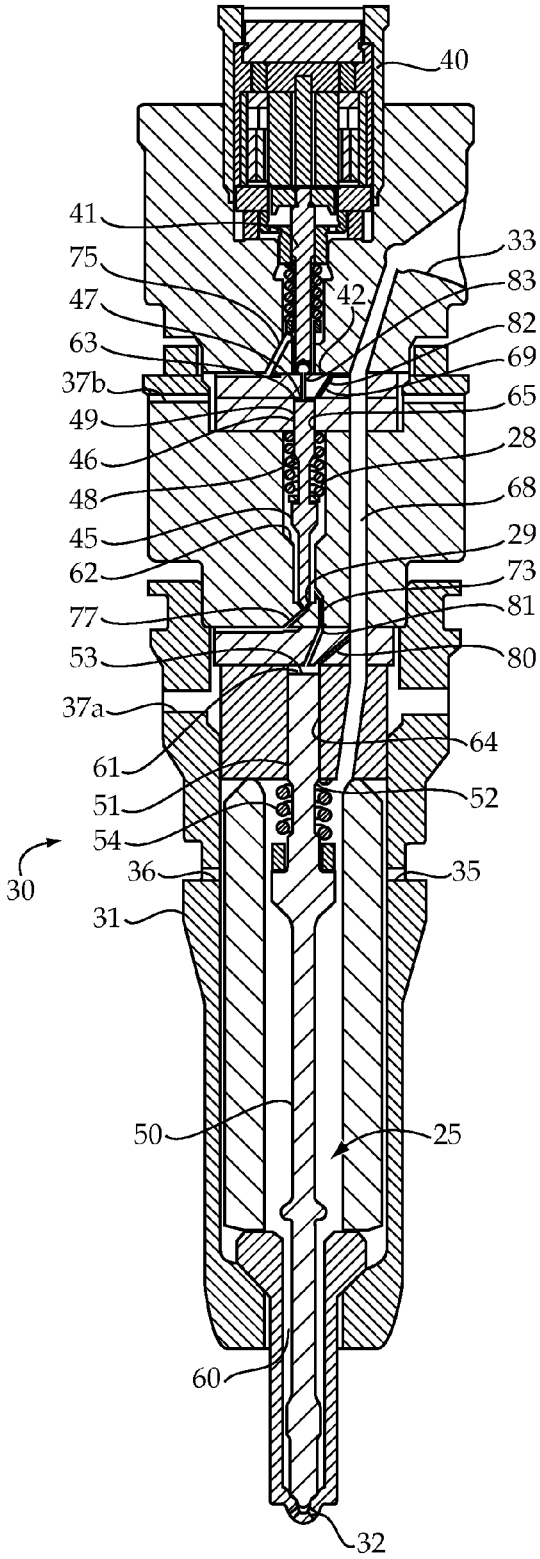
FIG. 2 is a sectioned side diagrammatic view of a fuel injector for the fuel system of FIG. 1.

Referring now to FIG. 2, each fuel injector 30 includes an injector body 31 that defines a common rail inlet 33, a nozzle outlet 32, a drain outlet(s) 37*a* and 37*b*, a cooling inlet 35 and a cooling outlet 36. Each fuel injector 30 also includes an electrical actuator 40, such as a solenoid or a piezo, that controls the opening and closing of a direct operated nozzle check valve 25. As used in the context of the present disclosure, a direct operated nozzle check valve is a valve that opens and closes the nozzle outlets by moving a valve member responsive to pressure changes on a closing hydraulic surface by energizing and deenergizing electrical actuator 40. In the illustrated fuel injector 30, direct operated nozzle check valve 25 is operably coupled to electrical actuator 40 by a pilot valve member 41 and a control valve member 45. Electrical actuator 40, pilot valve member 41 and control valve member 45 may closely resemble an electrical actuator, pressure control valve member and nozzle needle valve member associated with a small bore fuel injector. Thus, the fuel injector 30 of the present disclosure may leverage and actually use proven components associated with smaller bore fuel systems. However, instead of injecting fuel, those components are now utilized in the large bore fuel injector 30 to control pressure in a needle control chamber 61 to act on a closing hydraulic surface 53 of needle valve member 50.

The direct operated nozzle check valve 25 includes needle valve member 50, which is biased to a position to close nozzle outlets 32 by a spring 54. Needle valve member 50 includes an opening hydraulic surface 52 exposed to fluid pressure in a nozzle chamber 60, and a closing hydraulic surface 53 exposed to fluid pressure in needle control chamber 61. Needle valve member 50 is guided in its movement by interaction between guide surface 51 and a guide bore 64. The guide clearance 55 between guide surface 51 and guide bore 64 is relatively small, but inherently allows for some fluid communication between nozzle chamber 60 and needle control chamber 61. However, between injection events, both nozzle chamber 60 and needle control chamber 61 are maintained at rail pressure via nozzle supply passage 68 and main balance orifice 80. Nozzle supply passage 68 extends between nozzle chamber 60 and common rail inlet 33, while main balance orifice 80 fluidly connects needle control chamber 61 to nozzle supply passage 68 via a constricted but always open flow area. During an injection event, when pressure is reduced in needle control chamber 61, some fuel can migrate along guide clearance 55 from nozzle chamber 60 to needle control chamber 61.

Needle control chamber 61 is fluidly connected to an intermediate control chamber 62 via a pressure control passage 73 that includes a main control orifice 81. Control valve member 45, which was mentioned earlier, moves in intermediate control chamber 62 into and out of contact with a conical seat 29. A spring 28 biases control valve member 45 into contact with seat 29 to close the fluid connection between intermediate control chamber 62 and a low pressure drain passage 77 that fluidly connects to drain outlet 37*a*. Thus, when control valve member 45 lifts out of contact with seat 29, a direct fluid connection is made between the common rail 16 and drain outlet 37*a* via nozzle supply passage 68, through main balance orifice 80, through needle control chamber 61, up through pressure control passage 73, past seat 29 and through low pressure drain passage 77. When in this condition, pressure will drop in needle control chamber 61 by sizing main balance orifice 80 to be smaller than main control orifice 81. When this occurs, needle valve member 50 can lift to an open position to allow fuel to spray through nozzle outlets 32.

Control valve member 45 includes an opening hydraulic surface 48 exposed to fluid pressure in intermediate control chamber 62, and a closing hydraulic surface 47 exposed to fluid pressure in a pilot control chamber 63. The movement of control valve member 45 is guided by an interaction between a guide surface 46 and a guide bore 65. Although intermediate control chamber 62 is substantially fluidly isolated from pilot control chamber 63, some fluid communication exists along the small guide clearance 49 defined between guide surface 46 and guide bore 65. Pilot control chamber 63 is always fluidly connected to common rail pressure via pilot balance orifice 82 that opens at one end into nozzle supply passage 68 and at its other end into pilot control chamber 63. When electrical actuator 40 is energized, a pilot valve member 41 can lift off of a flat seat 42 to fluidly connect pilot control chamber 63 to low pressure drain 37*b* via pilot control orifice 83 and low pressure drain passage 75. By carefully selecting the flow areas of main balance orifice 80, main control orifice 81, pilot balance orifice 82 and pilot control orifice 83 as well as the pre-load on spring 28 and the relative sizes of opening hydraulic surface 38 and closing hydraulic surface 47, control valve member 45 will move off of seat 29 when pilot valve member lifts off of flat seat 42 to fluidly connect pilot control chamber 63 to drain. In general, main balance orifice 80 will be smaller than main control orifice 81, and pilot balance orifice 82 will have a smaller flow area than pilot control orifice 83. But the sizing must be such that when control valve member 45 is off of seat 29 to fluidly connect intermediate control chamber 62 to drain passage 77, there should be sufficient pressure acting on opening hydraulic surface 48 to overcome both spring 28 and the residual lower pressure on closing hydraulic force on closing hydraulic surface 47. Between injection events, pilot valve member 41 is in a downward position to close flat seat 42 resulting in pressure in pilot control chamber 63 and intermediate control chamber 62 being at rail pressure. Thus, between injection events there should be little to no leakage in fuel injector 30 since nozzle outlets 32 are closed, control valve member 45 is seated to close low pressure drain passage 77, and pilot valve member 41 is seated to close pilot control orifice 83. Although readily apparent, nozzle chamber 62, needle control chamber 61, intermediate control chamber 62 and pilot control chamber 63 are all disposed in injector body 31.

Fuel injector 30 can be thought of as having a non-injection configuration in which electrical actuator 40 is deenergized, pilot valve member 41 is in its downward position in contact to close flat seat 42, control valve member 45 is biased downward via spring 28 to close seat 29, and needle valve member 50 is in its downward position to close nozzle outlets 32. Fuel injector 30 can also be thought of as having an injection configuration in which needle valve member 50 is moved upward to open nozzle outlets 32, control valve member 45 is moved upward to open intermediate control chamber 62 to low pressure drain passage 77, and pilot valve member 41 is moved upward by electrical actuator 40 to fluidly connect pilot control chamber 63 to low pressure drain passage 75. Thus, when fuel injector 30 is in its injection configuration, drain outlet 37*a* and 37*b* are fluidly connected to common rail inlet 33 through two different passageways. One of these passageways includes low pressure drain passage 75, pilot control orifice 83, pilot control chamber 63, pilot balance passage 69 and a short segment of nozzle supply passage 68. The second of these passageways includes to flow pressure drain passage 77, intermediate control chamber 62, pressure control passage 73, needle control chamber 61, main balance orifice 80, and a segment of nozzle supply passage 68. Thus, during injection events, one could expect some fuel low to drain outlets 37*a* and 37*b* to be returned to source of heavy fuel oil 12 via return line 19 (FIG. 1). Both the pilot control chamber 63 and needle control chamber 61 are fluidly connected to common rail inlet 33 when fuel injector 30 is in its fuel injection configuration and in its non-injection configuration.

Figure 3:
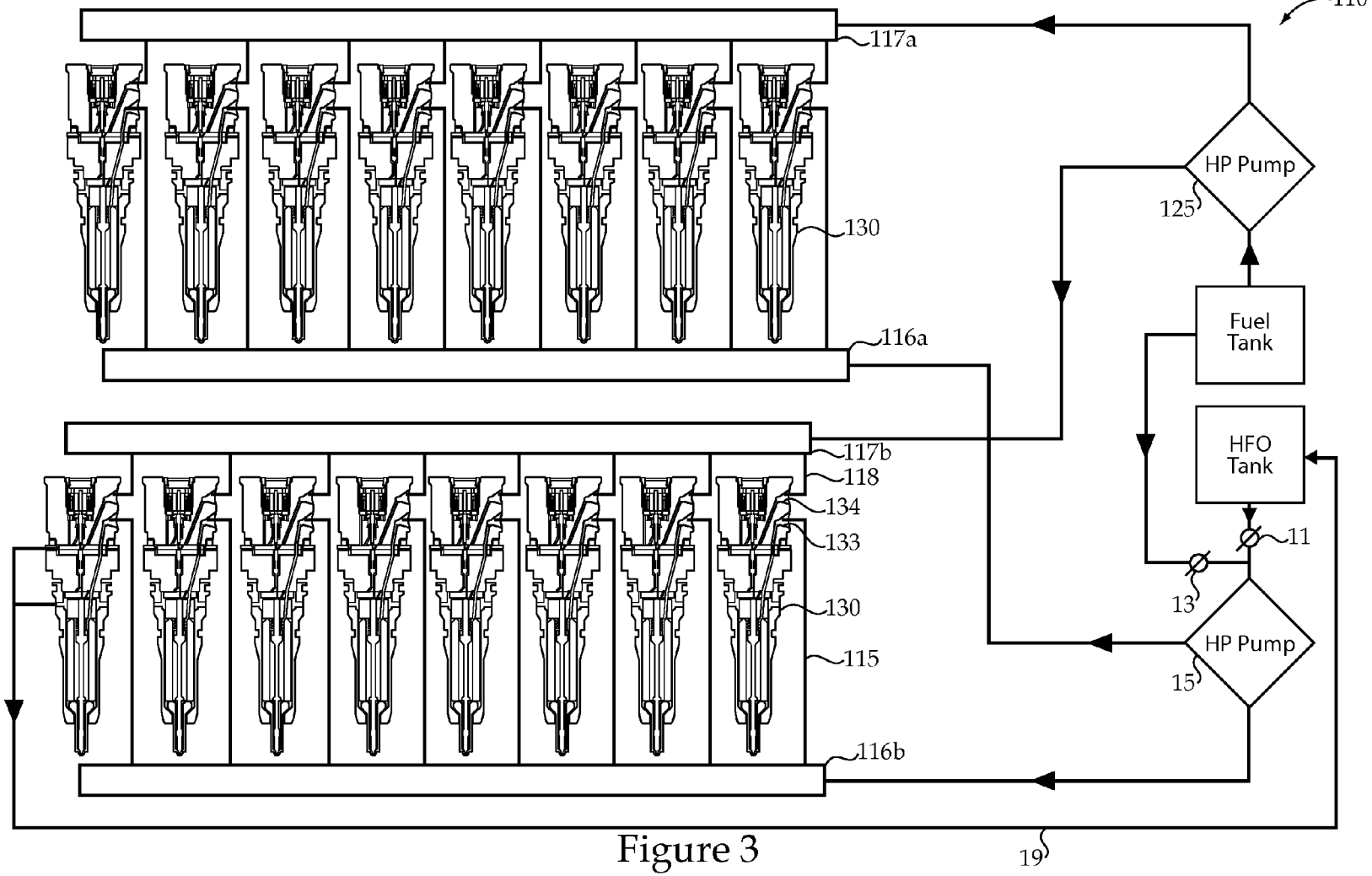
FIG. 3 is a schematic view of a large bore fuel system according to another embodiment of the present disclosure.

Referring now to FIG. 3, a large bore fuel system 110 according to another embodiment of the present disclosure differs from that of FIG. 1 in that only distillate diesel fuel is used at all times for pilot control functions, but either distillate diesel fuel or heavy fuel oil may be injected from the injectors 130. Like numbers are utilized to identify the features that are identical to those earlier described with regard to FIG. 1. And, unnumbered identical features are the same as the embodiment of FIGS. 1 and 2. In addition, the cooling circuit and fuel heater for heating the heavy fuel oil are omitted from FIG. 3 for the sake of clarity, but should be considered part of fuel system 110 in the manner previously described with regard to the fuel system 10 of FIG. 1. Like the embodiment of FIG. 1, valves 11 and 13 can be set such that high pressure pump pressurizes common rails 116*a* and 116*b* with heavy fuel oil from tank 12 or distillate diesel fuel from tank 14. The fuel in common rails 116*a* and 116*b* is utilized for injection purposes from the respective fuel injectors 130. The fuel is supplied from common rails 116*a* and 166*b* to the individual fuel injectors 130 via an individual branch passage 115 that may be portion of a quill that is received in common rail inlet 133, which may have a conical shape for appropriate sealing. A separate high pressure pump 125 utilizes distillate diesel fuel from tank 14 and pressurizes a control common rail(s) 117*a* and 117*b*. The common rails 117*a* and 117*b* are fluidly connected to individual fuel injectors 130 via individual branch passage 118, which may be a portion of a second quill that is received in common rail inlet 134, which may also have a conical shape for appropriate sealing with the quill. Although not necessary, it may be desirable to maintain control common rails 117*a* and 117*b* at an equal or slightly higher pressure than the injection common rails 116*a* and 116*b*. If fuel tends to migrate along clearance surfaces within fuel injector 130 during or between injection events, it will tend to migrate from the distillate diesel fuel areas associated with control common rails 117*a* and 117*b* toward the injection areas associated with injection common rails 116*a* and 116*b*. Thus, as stated earlier, dilution of heavy fuel oil with distillate diesel fuel is preferred over contamination of distillate diesel fuel with heavy fuel oil.

Figure 4:
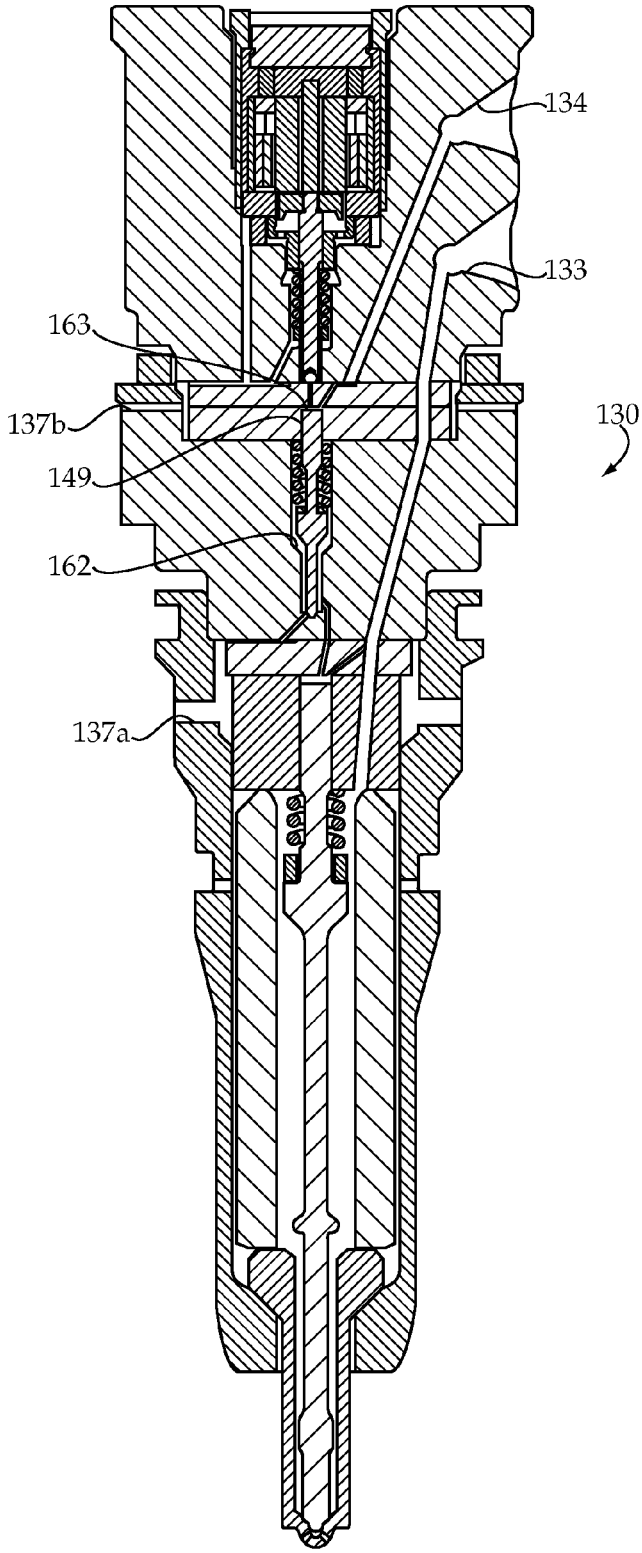
FIG. 4 is a sectioned side diagrammatic view of a fuel injector for the fuel system of FIG. 3.

Referring now to FIG. 4, fuel injectors 130 are similar in almost all respects to fuel injectors 30 described earlier except that pilot control chamber 163 is only connected to common rail inlet 134, whereas intermediate control chamber 162 may be fluidly connected to common rail inlet 133. Thus, when injecting heavy fuel oil, heavy fuel oil will occupy intermediate control chamber 162, but distillate diesel fuel will always inhabit pilot control chamber 163. If control common rails 117*a* and 117*b* are maintained at a slightly higher pressure than injection common rails 116*a* and 116*b*, one might expect some distillate diesel fuel migration from pilot control chamber 163 along guide clearance 149 and into intermediate control chamber 162. Otherwise, all of the internal features of fuel injector 130 and its operation are identical to fuel injector 30 and will not be repeated again.

INDUSTRIAL APPLICABILITY

The present disclosure finds general applicability to large bore fuel systems capable of injecting either heavy fuel oil or distillate diesel fuel into the combustion spaces of relatively large compression ignition engines. The present disclosure also finds applicability in reducing leakage in large bore fuel systems. Finally the present disclosure finds particular applicability in leveraging components associated with low leakage small bore fuel systems, and using those proven components and strategies in an almost identical manner in a large bore fuel system.

This aspect of the disclosure is demonstrated by control valve member 45 being substantially identical to a needle valve member of a counterpart small bore fuel injector, with seat 29 corresponding to the seat adjacent the sac region of the fuel injector, and drain passage 77 corresponding to the nozzle outlets of the counterpart small bore fuel injector. In addition, one might expect to see a virtually identical electrical actuator 40 and pilot valve member 41 in use with a counterpart small bore fuel injector.

With regard to FIGS. 1-4 and the fuel systems 10, 110, fuel injection occurs when the fuel injectors 30, 130 are in an injection configuration, and no injection occurs when the fuel injectors 30, 130 are in a non-injection configuration, as described earlier. During an injection event, the drain outlet 37*a* and/or 37*b* are fluidly connected to a common rail inlet 33, 133 or 134. For instance, in referring specifically to FIG. 2, during an injection event, pilot valve member 41 will be lifted off of seat 42 so that a fluid connection is made between common rail inlet 33, through a segment of nozzle supply passage 68, through pilot balance passage 69, through pilot control chamber 63, through pilot control orifice 83, passed seat 42, into low pressure passage 75 and eventually thereafter to low pressure drain outlet 37*b*. In the case of fuel injector 130, the fluid connection is between common rail inlet 134 and low pressure drain outlet 137*b*. Referring again to FIG. 2, also during an injection event, a fluid connection exists from common rail inlet 33 through a segment of nozzle supply passage 68 through main balance orifice 80, through needle control chamber 61, up through pressure control passage 73, past seat 29, into intermediate control chamber 63, and into low pressure drain passage 77, and eventually to low pressure drain outlet 37*a*. In the case of fuel injector 130 of FIG. 4, this fluid connection is between common rail inlet 133 and low pressure drain passage 137*b*. Between injection events, these fluid connections are blocked. The first of these fluid connections is blocked by the pilot valve member 41 closing seat 42, and the second of these fluid connections is closed by control valve member 45 closing seat 29.

Fuel leakage from the fuel injector between injection events may be reduced by equalizing pressures in the pilot control chamber 63, 163 with that intermediate control chamber 62, 162. In the context of the present disclosure, equalizing pressure between the pilot control chamber 163 and the intermediate control chamber 162 means that the pressure differential between these two chambers is at or less than the pressure difference between common rails 117 and 116. Those skilled in the art will appreciate that if the duration between injection events is sufficiently long, pressure will equalize in these two chambers by the fluid communication along guide surface 149. Fuel leakage is also reduced by equalizing the pressures in the nozzle chamber 60 with the needle control chamber 61 by closing seat 29 and maintaining both of the chambers fluidly connected to nozzle supply passage 68 between injection events. Thus in the case of nozzle chamber 60, equalizing pressure with needle control chamber 61, in the context of the present disclosure that literally means that they are equal since they are fluidly connected to the same common rail via the shared nozzle supply passage 68. Thus, in the context of the present disclosure, the term "equalizing" means that given an adequate time for pressure fluctuations to damp out to the grade toward the pressure in the respective spaces to become equal. However, the durations between injection events may be so short that inadequate time is available for the pressures to actually become equal. On the other hand, in the case of the embodiment shown in FIGS. 1 and 2, equalize means equal.

Injection events are initiated and maintained by de-equalizing pressures in the pilot control chamber 63, 163 relative to that of intermediate control chamber 62, 162, and de-equalizing pressures between nozzle chamber 60 and needle control chamber 61. This is accomplished by energizing electrical actuator 40 to lift pilot valve member 41 to fluidly connect pilot control chamber 63, 163 to low pressure drain outlet 37*b*, 137*b*. Because the flow area through pilot balance orifice 82 is smaller than the flow area through pilot control orifice 83, pressure will drop in pilot control chamber 63, 163. When this occurs, the pressure acting on opening hydraulic surface 48 will overcome spring 28 and cause intermediate valve member 45 to lift to open seat 29. When this occurs, intermediate control chamber 62 is fluidly connected to low pressure drain outlet 37*a*. By making main balance orifice 80 with a smaller flow area than main control orifice 81, fluid pressure will drop in needle control chamber 61 allowing the hydraulic force on opening hydraulic surface 52 to overcome spring 54 and lift needle valve member 50 to its opening position. However, the sizes of the orifices 80, 81, 82 and 83 should be sized such that the pressure in intermediate control chamber 62 remains sufficiently high during an injection event that control valve member 45 remains off of seat 29 during the injection event. Otherwise, one could expect cyclic pressure changes in intermediate control chamber 62 causing the needle valve member 50 to chatter and repeatedly close the nozzle outlets, which may in some circumstances be desirable. By appropriately positioning valves 11 and 13 (FIGS. 1 and 3) heavy fuel oil may be injected in a first injection event, but distillate diesel fuel may be injected in some subsequent injection event by reversing the positions of valves 11 and 13.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel system comprising:

a source of heavy fuel oil;

a source of distillate diesel fuel;

a common rail fluidly connected to at least one of the source of heavy fuel oil and the source of distillate diesel fuel;

a plurality of fuel injectors that each include an injector body that defines at least one common rail inlet, a drain outlet, a nozzle outlet, a cooling inlet and a cooling outlet, and having disposed therein a pilot control chamber, an intermediate control chamber, a needle control chamber and a nozzle chamber; a pilot valve member movable between a first position at which the pilot control chamber is fluidly connected to the drain outlet, and a second position at which the pilot control chamber is blocked from the drain outlet; a control valve member with a guide surface separating a first hydraulic surface exposed to fluid pressure in the pilot control chamber, and a second hydraulic surface exposed to fluid pressure in the intermediate control chamber; a needle valve member of a direct operated nozzle check valve with a guide surface separating an opening hydraulic surface exposed to fluid pressure in the nozzle chamber, and a closing hydraulic surface exposed to fluid pressure in the needle control chamber; and an electrical actuator coupled to the direct operated nozzle check valve by the pilot valve member and the control valve member.

2. The fuel system of claim 1 wherein the at least one common rail inlet includes a first common rail inlet fluidly connected to a drain outlet through two internal passageways when in an injection configuration, and the first common rail inlet fluidly blocked to the drain outlet when in a non-injection configuration; and the control valve member includes a guide surface that partially defines a guide clearance that fluidly connects a pilot control chamber to an intermediate control chamber; and the pilot control chamber and the intermediate control chamber being fluidly connected to the common rail inlet when in the injection configuration and the non-injection configuration.

3. The fuel system of claim 2 wherein the control valve member is mechanically biased toward a position that closes a first one of the two internal passages; and the pilot valve member being mechanically biased toward a position that closes a second one of the two internal passages.

4. The fuel system of claim 1 including a cooling circuit fluidly connected to the cooling inlet, the cooling outlet and the source of distillate diesel fuel.

5. The fuel system of claim 1 including a heavy fuel heater operably positioned to heat heavy fuel oil in the source of heavy fuel oil.

6. The fuel system of claim 1 wherein the common rail is a first common rail fluidly connected to a first common rail inlet of the at least one common rail inlet of each of the fuel injectors and connected to the source of heavy fuel oil; and a second common rail fluidly connected to a second common rail inlet of each of the fuel injectors and connected to the source of distillate diesel fuel.

7. The fuel system of claim 1 wherein the at least one common rail inlet includes a first common rail inlet fluidly connected to a drain outlet through two internal passageways when in an injection configuration, and the first common rail inlet fluidly blocked to the drain outlet when in a non-injection configuration; and the control valve member includes a guide surface that partially defines a guide clearance that fluidly connects a pilot control chamber to an intermediate control chamber;

the pilot control chamber and the intermediate control chamber being fluidly connected to the first common rail inlet when in the injection configuration and the non-injection configuration;

a cooling circuit fluidly connected to the cooling inlet, the cooling outlet and the source of distillate diesel fuel; and a heavy fuel heater operably positioned to heat heavy fuel oil in the source of heavy fuel oil.

8. A fuel injector comprising:

an injector body that defines at least one common rail inlet, a drain outlet, a nozzle outlet, a cooling inlet and a cooling outlet, and having disposed therein a pilot control chamber, an intermediate control chamber, a needle control chamber and a nozzle chamber;

a pilot valve member movable between a first position at which the pilot control chamber is fluidly connected to the drain outlet, and a second position at which the pilot control chamber is blocked from the drain outlet;

a control valve member with a guide surface separating a first hydraulic surface exposed to fluid pressure in the pilot control chamber, and a second hydraulic surface exposed to fluid pressure in the intermediate control chamber; and a needle valve member with a guide surface separating an opening hydraulic surface exposed to fluid pressure in the nozzle chamber, and a closing hydraulic surface exposed to fluid pressure in the needle control chamber.

9. The fuel injector of claim 8 wherein the injector body defines a pilot balance passage fluidly connecting the pilot control chamber to the at least one common rail inlet; and the injector body defines a nozzle supply passage fluidly connecting the nozzle chamber to the at least one common rail inlet.

10. The fuel injector of claim 9 wherein the pilot balance passage is fluidly connected to a first common rail inlet of the at least one common rail inlet; and the nozzle supply passage is fluidly connected to a second common rail inlet of the at least one common rail inlet.

11. The fuel injector of claim 9 wherein the injector body has disposed therein a first low pressure drain passage fluidly connected to the pilot control chamber, a second low pressure drain passage fluidly connected to the intermediate control chamber, and a pressure control passage fluidly connecting the needle control chamber to the intermediate control chamber.

12. The fuel injector of claim 11 wherein the control valve member is movable between a first position in contact with a conical seat to close the intermediate control chamber to the second low pressure drain passage, and a second position out of contact with the conical seat to open the intermediate control chamber to the second low pressure drain passage; and the pilot valve member is movable between a first position in contact with a seat to close the pilot control chamber to the first low pressure drain passage, and a second position out of contact with the seat to open the pilot control chamber to the first low pressure drain passage.

13. The fuel injector of claim 12 wherein the injector body has disposed therein a main balance orifice fluidly connecting the needle control chamber to the nozzle supply passage.

14. The fuel injector of claim 13 including a spring operably positioned to bias the control valve member toward one of the first position and the second position.

15. A method of operating a fuel system comprising the steps of:

providing a plurality of fuel injectors that each include an injector body that defines at least one common rail inlet, a drain outlet, a nozzle outlet, a cooling inlet and a cooling outlet, and having disposed therein a pilot control chamber, an intermediate control chamber, a needle control chamber and a nozzle chamber; a pilot valve member movable between a first position at which the pilot control chamber is fluidly connected to the drain outlet, and a second position at which the pilot control chamber is blocked from the drain outlet; a control valve member with a guide surface separating a first hydraulic surface exposed to fluid pressure in the pilot control chamber, and a second hydraulic surface exposed to fluid pressure in the intermediate control chamber; a needle valve member of a direct operated nozzle check valve with a guide surface separating an opening hydraulic surface exposed to fluid pressure in the nozzle chamber, and a closing hydraulic surface exposed to fluid pressure in the needle control chamber; and an electrical actuator coupled to the direct operated nozzle check valve by the pilot valve member and the control valve member;

fluidly connecting the drain outlet to a common rail inlet of the at least one common rail inlet during an injection event; and fluidly blocking the drain outlet from the common rail inlet between injection events; and reducing fuel leakage from the fuel injector between injection events by equalizing pressures in the pilot control chamber and the intermediate control chamber that are separated by the guide surface of a control valve member, and equalizing pressures in the nozzle chamber and the needle control chamber that are separated by the guide surface of the needle valve member.

16. The method of claim 15 wherein an injection event includes de-equalizing pressures in the pilot control chamber and the intermediate control chamber, and de-equalizing pressures in the nozzle chamber and the needle control chamber.

17. The method of claim 16 wherein the fluidly blocking step includes positioning the pilot valve member in contact with a first seat, and positioning a control valve member in contact with a second seat.

18. The method of claim 17 wherein an injection event includes energizing an electrical actuator to move the pilot valve member out of contact with the first seat to open a fluid connection between the pilot control chamber and a first low pressure drain passage;

reducing pressure in the pilot control chamber responsive to opening the fluid connection between the pilot control chamber and the first low pressure drain passage;

moving the control valve member out of contact with the second seat responsive to the pressure reduction in the pilot control chamber to open a fluid connection between the intermediate control chamber and a second low pressure drain passage;

reducing pressure in the intermediate control chamber responsive to opening the fluid connection between the intermediate control chamber and the second low pressure drain passage;

reducing pressure in the needle control chamber responsive to reducing pressure in the intermediate control chamber; and moving a needle valve member out of contact with a third seat to fluidly open the nozzle chamber to a nozzle outlet responsive to reducing pressure in the needle control chamber.

19. The method of claim 15 including injecting heavy fuel oil in a first injection event; and injecting distillate diesel fuel in a second injection event.

20. The method of claim 19 including a step of filling the pilot control chamber with distillate diesel fuel during the first injection event.

* * * * *